United States Patent [19]

Owens et al.

[11] Patent Number: 4,694,264

[45] Date of Patent: Sep. 15, 1987

[54] RADIO FREQUENCY COAXIAL FEEDTHROUGH DEVICE

[75] Inventors: Thomas L. Owens, Kingston; Frederick W. Baity, Oak Ridge; Daniel J. Hoffman, Oak Ridge; John H. Whealton, Oak Ridge, all of Tenn.

[73] Assignee: The United States of America as represented by the United States Department of Energy, Washington, D.C.

[21] Appl. No.: 836,776

[22] Filed: Mar. 5, 1986

[51] Int. Cl.[4] ..... H01P 5/02

[52] U.S. Cl. ..... 333/34; 333/22 F; 333/260; 333/243

[58] Field of Search ..... 333/22 F, 27, 245, 252, 333/260, 34

[56] References Cited

U.S. PATENT DOCUMENTS

| | | | |
|---|---|---|---|
| 3,058,073 | 10/1962 | Eldredge | 333/260 |
| 3,065,377 | 11/1962 | Eakin | 333/251 X |
| 3,906,402 | 9/1975 | Lesyk | 333/22 F X |

*Primary Examiner*—Paul Gensler

*Attorney, Agent, or Firm*—David E. Breeden; Stephen D. Hamel; Judson R. Hightower

[57] ABSTRACT

A radio frequency coaxial vacuum feedthrough is provided which utilizes a cylindrical ceramic vacuum break formed of an alumina ceramic. The cylinder is coaxially disposed and brazed between tapered coaxial conductors to form a vacuum sealed connection between a pressurized upstream coaxial transmission line and a utilization device located within a vacuum container. The feedthrough provides 50 ohm matched impedance RF feedthrough up to about 500 MHz at power levels in the multimegawatt range.

7 Claims, 4 Drawing Figures

RADIO FREQUENCY COAXIAL FEEDTHROUGH DEVICE

BACKGROUND OF THE INVENTION

Radio frequency (RF) heating of fusion plasmas in the ion cyclotron range of frequencies (ICRF), typically between about 10 and 200 MHz, is now being widely applied to fusion experiments around the world. It is currently invisioned that fusion reactors will use this method of heating to supplement ohmic heating and neutral beam heating. Power levels are now in the multimegawatt range and experiments are frequently being limited by breakdown at the vacuum feedthrough, i.e., the RF coupling between a pressurized coaxial transmission line and the plasma vacuum containment vessel. This barrier between the pressurized line and the evacuated line within the vacuum vessel is a particularly crucial component because its failure affects not only the RF system but also the entire vacuum integrity in many circumstances. This component has also been the weak link in voltage handling for some contemporary pulsed experiments. The potential problems at the feedthrough are compounded by operation approaching steady-state.

Various development programs have been undertaken to develop feedthrough designs for specific applications. One such program has been underway at the Princeton Plasma Physics Laboratory for a number of years. Their efforts have led to the development of a high-power feedthrough used in ICRF heating experiments on the Princeton Large Torus (PLT). The PLT feedthrough is the subject of the U.S. Pat. No. 4,484,019 issued Nov. 20, 1984, to Glenn F. Grotz for a "High Voltage RF Feedthrough Bushing" and having a common assignee with the present invention, the contents of which are incorporated herein by reference thereto. The PLT feedthrough uses a conical ceramic barrier between inner and outer coaxial conductors. The conductors are shaped primarily to reduce the component of the electric field along the surface of the ceramic. The conical-shaped barrier is difficult to manufacture and assemble into a connector to obtain matched impedance and eliminate internal reflections. Further, the PLT feedthrough is limited in operation to RF frequencies below about 200 megahertz.

Thus, it will be seen that there is a need for an improved RF vacuum feedthrough for use at higher frequencies and power levels which is less complicated in design, provides matched impedance along the length of the feedthrough and minimizes internal reflections.

SUMMARY OF THE INVENTION

In view of the above need, it is an object of this invention to provide an improved coaxial feedthrough which is capable of transmitting RF energy from a pressurized coaxial transmission line to a line of substantially lower pressure at frequencies up to at least 500 MHz and at power levels up to at least 1 megawatt.

Another object of this invention is to provide a coaxial feedthrough as in the above object which is easily assembled from parts of simple geometric shapes.

Yet another object of this invention is to provide a coaxial feedthrough as in the above objects in which constant characteristic impedance is maintained in the transition from a large-diameter pressurized transmission line to a smaller diameter line of lower pressure to minimize the insertion-voltage-standing-wave ratio (IVSWR) and eliminate internal reflections.

Another object of this invention is to provide a coaxial vacuum feedthrough which may be easily adapted to long-pulse or continuous wave (cw) use at high power levels.

Other objects and many of the attendant advantages of the present invention will become apparent to those skilled in the art from the following detailed description of a preferred embodiment of the invention taken in conjunction with the drawings.

In summary, the invention pertains to a RF coaxial feedthrough comprising a cylindrical insulating barrier coaxially disposed between uniformly tapered inner and outer coaxial conductors so as to create an electric field therebetween which is directed nearly perpendicular to the surfaces of the cylindrical insulating barrier. This structure minimizes the possibility of surface breakdown along the cylinder while providing the accurate maintenance of a constant characteristic impedance along the feedthrough. Thus, the insertion-voltage-standing wave ratio is minimized and internal reflections are eliminated which improves the peak-power-handling capability of the feedthrough. This invention affords the use of relatively simple fabrication techniques and it is easily adaptable to long-pulse or continuous wave use.

DETAILED DESCRIPTION

Figure 1:
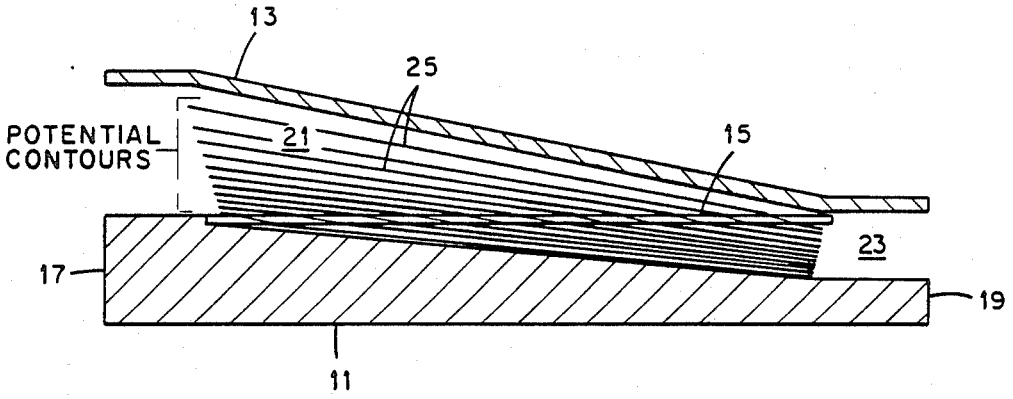
FIG. 1 is a simplified schematic diagram of a partial cross section depicting the coaxial feedthrough concept according to the present invention.

Referring now to FIG. 1, the feedthrough concept according to the present invention is illustrated in schematic form for connecting a pressurized large diameter coaxial transmission line to a smaller diameter vacuum operated coaxial transmission line. The feedthrough comprises an inner tapered conductor 11, an outer tapered coaxial conductor 13 and a cylindrical insulator barrier 15 formed of a ceramic electrical insulating material, such as alumina. The feedthrough is connected at an upstream end 17 to a gas-filled high voltage coaxial transmission line, or other suitable source of high voltage RF power, while the downstream end 19 is connected to a coaxial line or RF power utilization device, such as an antenna disposed in a vacuum environment. The insulator 15 forms a vacuum barrier between a gas-filled annular cavity 21 which communicates with the pressurized gas dielectric, such as $SF_6$ at a pressure of 0–10 atmospheres, of the upstream end transmission line and an annular vacuum cavity 23 which communicates with the downstream vacuum system. The insulating cylinder supports the inner conductor and may be brazed at the upstream and downstream ends to the inner and outer conductors, respectively, to form a vacuum-tight seal. In this case, the insulating barrier 15 is much longer than its diameter. This permits the construction of very gradual tapers of the inner and outer conductors toward the center of feedthrough. This, in turn, produces potential contours, shown by superimposed lines 25, that are nearly parallel to the surface of the insulator 15 so that the electric field (E) is nearly perpendicular to the surface of the insulator 15. This substantially reduces the possibility of surface breakdown along the insulator surface due to the long breakdown path and eliminates the need for large diameter structures.

A constant characteristic impedance results from the use of the straight tapers on the inner and outer conductors. Maintenance of a constant characteristic impedance with a value equal to the connecting transmission line (typically 50 ohms) minimizes voltages on the feedthrough and on the connecting transmission lines. This is because the maximum voltage on a transmission line is governed by the relation, $$V_{max}=(PZ_oS)^{\frac{1}{2}},$$

where P is the input power, $Z_o$ is the transmission line characteristic impedance, and S is the voltage standing-wave ratio. If the feedthrough characteristic impedance equals $Z_o$, then S will be minimized for a given load impedance, which in turn minimizes $V_{max}$. The characteristic impedance of the feedthrough is governed by the ratio of outer conductor radius to inner conductor radius.

A constant characteristic impedance results from the use of the straight tapers on inner and outer conductors. The value of the characteristic impedance for tapered lines is found approximately from $$Z_f=\sqrt{\frac{L_l}{C_l}}\simeq\frac{1}{2\pi}\sqrt{\frac{\mu}{\epsilon}}\,\mathrm{Ln}\left[\frac{z_{\bullet}\tan\left[\frac{\theta_2}{2}\right]}{\tan\left[\frac{\theta_1}{2}\right]}\right],$$

where $\mu$ is $4\pi\times10^{-7}$ henrys/meter, $\epsilon$ is $8.854\times10^{-12}$ farads/meter, $L_l$ is the inductance per unit length, $C_l$ is the capacitance per unit length. and $\theta_2$ and $\theta_1$ are the angles made by the outer and inner conductors, respectively, relative to the axis of the feedthrough.

Figure 2:
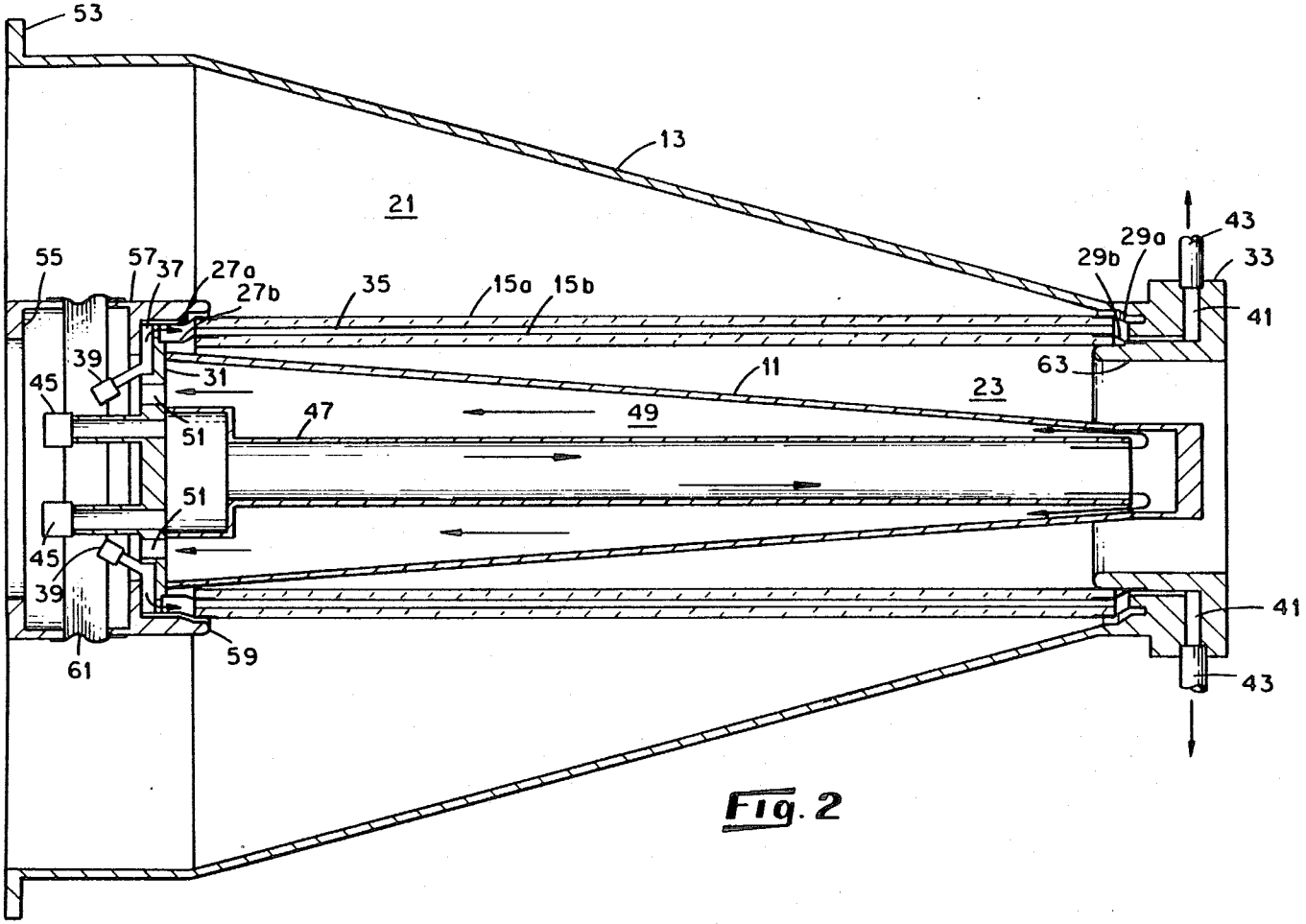
FIG. 2 is a cross-sectional view of one embodiment of a coaxial vacuum RF feedthrough employing the concept shown in FIG. 1.

The cylindrical ceramic barrier not only provides a simpler feedthrough construction, but also simplifies the problem of cooling the ceramic in high power applications where cooling is required. Referring now to FIG. 2, wherein like reference numerals refer to identical parts shown in FIG. 1, there is shown one embodiment of the invention in which cooling of the ceramic is accomplished by flowing a coolant, such as water, between concentric cylindrical ceramics 15*a* and 15*b*. These cylinders may be purchased commercially in specified sizes preferably formed of alumina ($Al_2O_3$) of specified purity. Typically, the cylinders are at least 94% pure $Al_2O_3$ which may be purchased from various ceramic suppliers. The cylinders are brazed at each end to metal mounting rings which are connected to the inner conductor 11 and outer conductor 13, respectively, so that the inner conductor is supported in proper coaxial alignment with the outer conductor. The mounting rings 27*a* and 27*b* may be attached to an upstream end closure member 31 of the inner conductor structure in a concentric spaced relationship to form a cooling channel 35 therebetween which is in fluid communication with an annular coolant header 37. The coolant is supplied to the header 37 through hoses (not shown) connected to couplings 39. The mounting rings 29*a* and 29*b* may be attached to a flange member 33 forming a downstream end portion of the outer conductor in a corresponding concentric spaced relationship. The flange 33 has an annular exhaust manifold 41 through which the coolant flows exiting the system through ports 43.

This embodiment further illustrates one means by which the inner conductor 11 may also be cooled by introducing coolant through inlet ports 45 in the end closure member 31 which flows through a central coaxially disposed inlet tube 47 to the downstream end of the inner conductor and back through the chamber 49 formed between the inlet tube 47 and the inner walls of conductor 11 before exiting through exhaust ports 51 in the end member 31. Ports 45 and 51 may also be connected through hosing to an external coolant circulating system (not shown). These coolant connections may be made through conventional impedance matching stubs in the upstream coaxial line connected to the feedthrough. All coolant connections are made on the inside of the inner conductor so that Rf power is kept off the coolant lines, since RF currents flow only on the outside of the inner conductor.

The upstream end of the feedthrough is adapted to be connected to a coaxial transmission line with the outer conductors connected by means of a flange 53 and the inner conductors connected through a flange 55 of a coupling sleeve 57. The sleeve 57 includes a corona shield 59 in the form of a guard ring which extends over the ceramic mounting rings 27. An expansion joint 61 may also be provided in the sleeve 57 to allow for longitudinal expansions of the ceramic tubes 15 and the connecting transmission line. An additional corona shield 63 is provided at the downstream connecting end of the ceramic tube 15 which extends over the support rings 29 on the inside diameter of the ceramic tube 15*b*.

Figure 3:
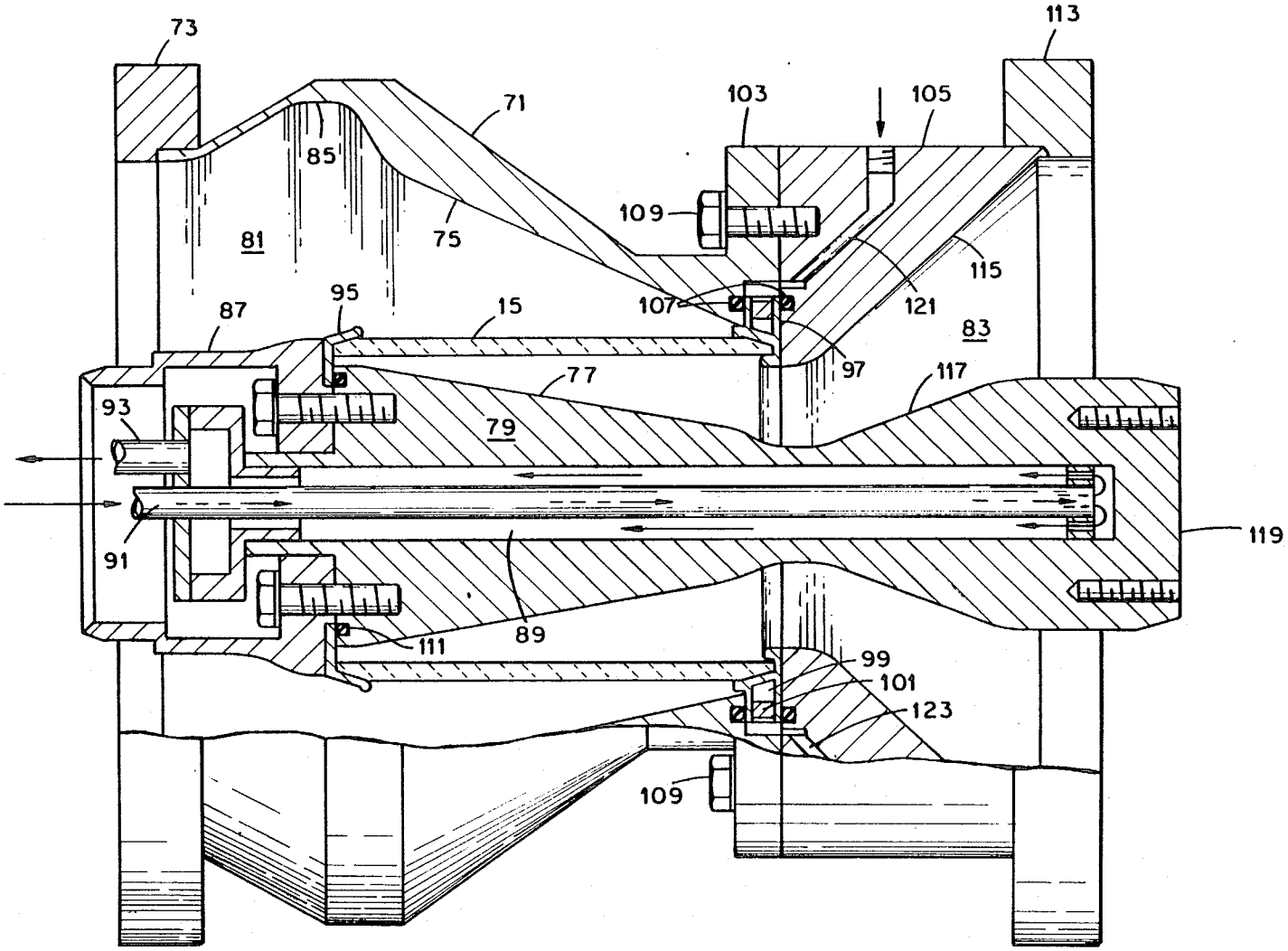
FIG. 3 is a cross-sectional view of an alternate embodiment of a vacuum RF feedthrough made in accordance with the present invention.

Referring now to FIG. 3, there is shown an embodiment of the invention which has been adapted for an application in which spacing constraints prevent the use of an extremely long cylindrical ceramic insulator/barrier 15. The outer conductor is formed of a copper coated stainless steel cylinder 71 which is sealably welded to an upstream flange 73 for connection to the outer conductor of an 8-inch pressurized transmission line (not shown). The outer conductor 71 has an inner constant tapered portion 75 which is matched to the inward tapered portion 77 of the inner conductor 79 so that the spacing ratio between the tapered surfaces 75 and 77 remains constant through the region of the insulator 15 to provide a constant characteristic impedance along the transition between the pressurized region 81 and the vacuum region 83.

To maintain matched impedance throughout the feedthrough coupling and thereby minimize the IVSWR, the upstream end of the inner surface of outer conductor 71 is formed of an enlarged diameter segment 85 to maintain the constant spacing ratio relative to the inner conductor contour so that the constant characteristic impedance of the connecting transmission line is maintained through the upstream transition portion of the feedthrough. An adapter coupling 87 is bolted to the upstream end of the inner conductor 79 through which connection is made to the inner conductor of the pressurized transmission line. As in the previous embodiment, an inner conductor cooling channel 89 is provided in the inner conductor which communicates with input and output coolant flow ports 91 and 93, respectively, provided within the inner conductor coupling member 87, as shown.

The ceramic cylinder 15 is brazed to electrically conductive metal rings 95 and 97 at the upstream and downstream ends respectively. The upstream ring 95 has an annular spacing flange portion which extends radially inward over the end of cylinder 15 and is sandwiched between the coupling 87 and the inner conductor 79 during assembly. The downstream end ring 97 extends about the end of the cylinder 15 and has a pair of radially outward extending annular flanges which form an annular channel 99 in which a two-piece stainless steel reinforcing ring 101 is disposed to prevent bending of the annular flanges when assembled. The annular channel 99 of ring 97 is disposed in an annular recess of a downstream end faceplate 103 of the outer conductor cylinder 71 which is bolted to a downstream outer conductor transition coupling 105. Metal O-ring seals 107 are provided as shown between the annular channel 99 and the faceplate 103 and coupling 105 adjacent the location of the support ring 101. This provides a vacuum-tight seal between pressurized region 81 and the vacuum region 83 when the parts are bolted together by means of a plurality of blots 109 which extend through the faceplate 103 and threadably engage the coupling 105. Another metal O-ring 111 is provided between the upstream end mounting ring 95 and the upstream end of the inner conductor 79 to provide a vacuum tight seal at the upstream end of the ceramic barrier 15. The metal O-ring seals permit operation for extended periods of time in the radiation environments of a fusion experiment and at elevated temperatures. The O-rings are preferably "Helicoflex" seals which are available commercially from the Helicoflex Company, Boonton, N.J. These rings are formed of a nickel alloy (Nimonic 90) helical spring enclosed in a circular cross section outer aluminum jacket.

Although the vacuum feedthrough transition ends at the downstream end of the ceramic barrier 15, the interface between the outer conductor 71 and the coupling 105, this embodiment illustrates the manner in which the feedthrough may be easily adapted for various applications. In this case the downstream end is to be connected to a vacuum transmission line housing having an outer conductor of the same diameter as the pressurized transmission line. Thus, the coupling 105 is welded at the downstream end to a connecting flange 113 which is identical to flange 73 at the upstream end. The inner surface 115 of coupling 105, forming a continuation of the outer conductor, and the extending portion 117 of the inner conductor are tapered outwardly from the center axis to provide a constant characteristic impedance match in the transition coupling to the vacuum transmission line. The inner conductor 79 of the feedthrough is connected to the center conductor of the vacuum transmission line at the end face 119. Thus, the relative spacing requirements between the inner and outer conductors are maintained in the transition region which provides the required continuous characteristic impedance match.

The outer conductor, especially in the narrow portion thereof, may be cooled by providing coolant inlet and outlet channels 121 and 123 in the coupling 105 which are connected in fluid communication with an annular coolant chamber which surrounds the ceramic cylinder 15 connecting ring 97.

Further, additional advantages are obtained in the embodiment shown in FIG. 3 when the feedthrough is used in feeding RF power into the vacuum environment of a fusion device, for example, in that the downstream transition portion provides additional shielding of the ceramic 15 from particle radiation emanating from the plasma confined in the vacuum region.

In the embodiment shown in FIG. 3, the inner and outer conductor structural components are formed from stainless steel which has been coated with copper to a depth of about 0.003 inch to provide the required low resistance conducting surfaces.

The feedthrough shown in FIG. 3 has been designed as a 50 ohm matched feedthrough for use in fusion energy experiments to transmit RF energy from a pressurized transmission line ($SF_6$ at about 20 psig) to a vacuum transmission line operated at a hard vacuum of about $10^{-6}$ torr. Tests indicate that the feedthrough is capable of handling power levels greater than 1 megawatt in long pulse (3 seconds) operation at a voltage of 100 kv without breakdown. The length of the ceramic cylinder in this case is 4.875 inches.

Figure 4:
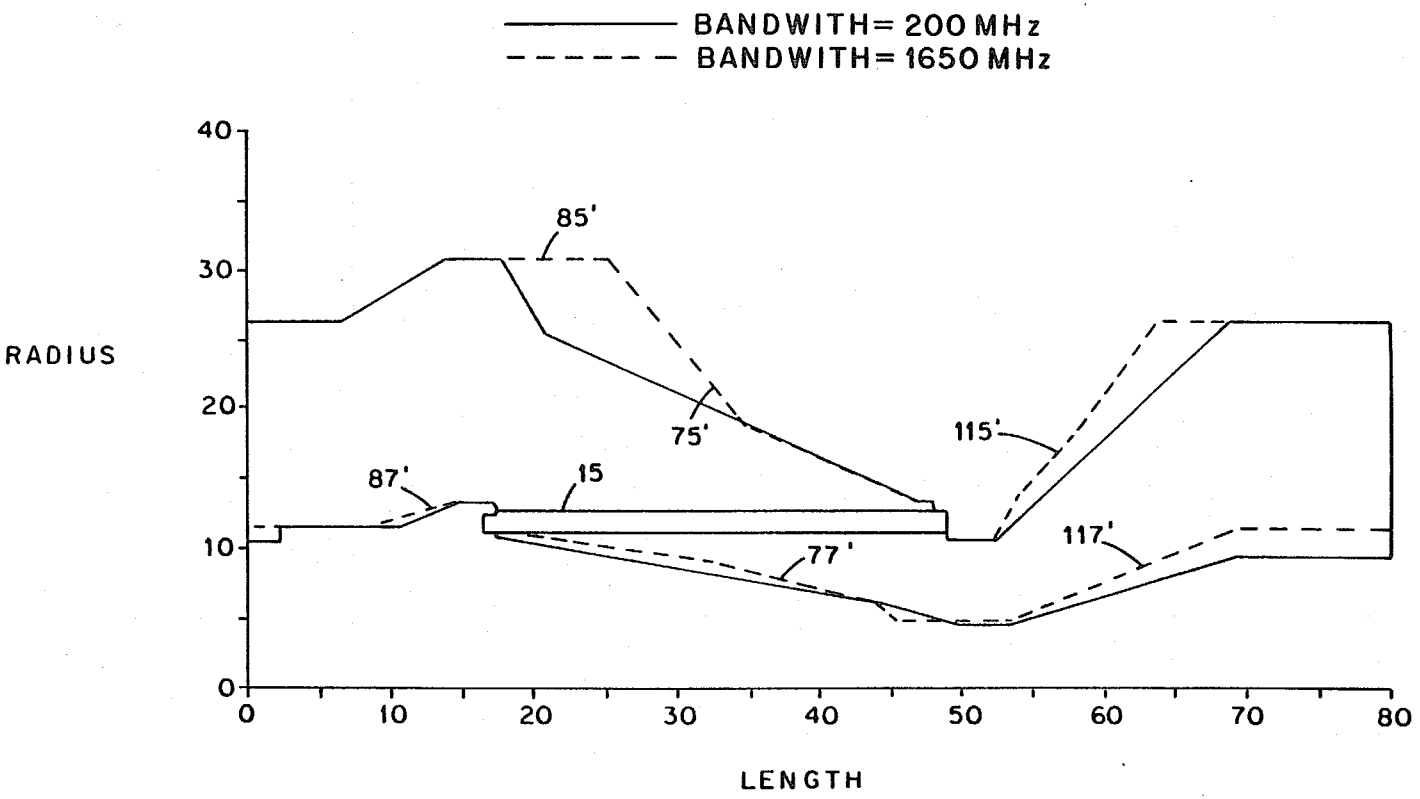
FIG. 4 is a partial, cross-sectional view of another alternate embodiment of a vacuum RF feedthrough made in accordance with the present invention. This view is a graphic illustration, in arbitrary units of radius and length, which compares the structure of this embodiment, shown by dotted lines, with the structure of FIG. 3 which is shown by solid lines. The similar parts of the embodiment are indicated by like primed reference numerals to that of FIG. 3.

Referring now to FIG. 4, there is illustrated another embodiment of the invention, wherein the inner and outer conductors are indicated by dashed lines, which further reduces spatial changes in the characteristics impedance over the structure of FIG. 3, shown by solid lines. In this embodiment the voltage standing wave ratio is reduced by a direct analysis of Laplace's equation and an infinitesimal circuit model. This procedure is found to be more accurate, and the FIG. 4 embodiment is therefore expected to produce the lowest standing wave ratio obtainable. The IVSWR has been determined to be less than 1.01:1 for frequencies below 200 MHz and less than 1.1:1 at frequencies less than 800 MHz.

Thus, it will be seen that an RF coaxial feedthrough has been provided which is simple to construct from geometrically simple components and which is capable of being easily adapted to various RF feedthrough applications at high voltages and currents for matched impedance and minimum IVSWR. Although the invention has been described by means of specific embodiments, it will be understood that various modifications and changes may be made therein without departing from the spirit and scope of the following claims attached to and forming a part of this specification. For example, in applications requiring a very short feedthrough design the taper angles of the inner and outer conductors may be arranged at steeper angles than that shown by increasing the diameter of the feedthrough as long as the angle of the electric field to the surface of the ceramic barrier does not fall substantially below 45° to prevent surface breakdown at high voltages.

We claim:

1. A high voltage radio frequency coaxial feedthrough device for transmitting high voltage radio frequency energy between first and second coaxial transmission lines of different dielectric mediums and pressures, comprising:

a tapered inner coaxial conductor including means for electrical connection at an upstream end thereof to an inner coaxial conductor of said first coaxial line and at a downstream end thereof to an inner coaxial conductor of said second coaxial line;

a tapered outer coaxial conductor including means for electrical connection at the upstream end thereof to an outer coaxial conductor of said first coaxial line and at the downstream end thereof to an outer coaxial conductor of said second coaxial line;

a coaxially disposed cylindrical insulator formed of a rigid, impermeable, electrically insulating material including first and second conductive metal mounting rings sealably brazed to the upstream and downstream ends respectively of said cylindrical insulator, said first ring having an axially extending portion forming a first guard ring which extends axially over a portion of the outer surface of said cylindrical insulator to form a corona shield about the upstream end of said cylindrical insulator, said second ring having an axially extending portion forming a second guard ring which extends over a portion of the inner surface of said cylindrical insulator to form a corona shield about the downstream end of said cylindrical insulator; and means for removably connecting said cylindrical insulator in a leak-tight sealing arrangement between said first mounting ring of said cylindrical insulator and said inner conductor at the upstream end of said cylindrical insulator and said second mounting ring of said cylindrical insulator and said outer conductor at the downstream end of said cylindrical insulator so that a leak-tight seal is provided between the different pressurized dielectric mediums of said first and second coaxial transmission lines, said inner and outer coaxial conductors being spaced apart and separately tapered uniformly along the outer and inner surfaces respectively inwardly from said upstream end of said cylindrical insulator toward the central axis of said coaxial feedthrough device and said inner surface of said upstream end of said outer conductor being formed of an enlarged diameter axial segment axially aligned with said first mounting ring of said cylindrical insulator so that a constant characteristic impedance is provided along the entire length of said feedthrough device while minimizing the insertion-voltage standing wave ratio of said feedthrough device.

2. The device of claim 1 wherein said outer conductor and said cylindrical insulator comprise pressure containment means for a dielectric gas forming the dielectric medium of said first coaxial transmission line and wherein said inner conductor and said cylindrical insulator means comprise a hard vacuum containment means forming the dielectric medium of said second coaxial transmission line.

3. The device of claim 2 wherein said cylindrical insulator is substantially longer in length than its diameter so that the electric field established between said inner and outer conductors is applied at an angle approaching 90° to the wall surfaces of said cylinder.

4. The device of claim 2 wherein said cylindrical insulator is a thin-walled cylinder formed of a ceramic insulating material.

5. The device of claim 4 wherein said ceramic insulating material is alumina having a purity of at least 94%.

6. The device of claim 2 wherein said cylindrical insulator means includes first and second coaxially disposed and spaced apart ceramic insulating cylinders forming a coolant passage therebetween and further includes coolant coupling means for passing cooling liquid through said coolant passage to cool said cylinders.

7. The device of claim 2 wherein said inner coaxial conductor further comprises axially extending cooling channels.

* * * * *